US009599386B2

(12) United States Patent
Grosse et al.

(10) Patent No.: US 9,599,386 B2
(45) Date of Patent: Mar. 21, 2017

(54) METHOD FOR FORMING ICE CUBES IN AN ICE MAKING DEVICE

(71) Applicant: Whirlpool Corporation, Benton Harbor, MI (US)

(72) Inventors: Alexandre D. Grosse, Iowa City, IA (US); Adriana Syliva Guillen, San Nicolas de Los Garza (MX)

(73) Assignee: Whirlpool Corporation, Benton Harbor, MI (US)

( * ) Notice: Subject to any disclaimer, the term of this patent is extended or adjusted under 35 U.S.C. 154(b) by 219 days.

(21) Appl. No.: 14/487,703

(22) Filed: Sep. 16, 2014

(65) Prior Publication Data

US 2015/0000311 A1 Jan. 1, 2015

Related U.S. Application Data

(62) Division of application No. 12/723,772, filed on Mar. 15, 2010, now Pat. No. 8,844,309.

(51) Int. Cl.

| | |
|---|---|
| ***F25C 5/08*** | (2006.01) |
| ***F25C 5/00*** | (2006.01) |
| ***F25C 1/16*** | (2006.01) |
| ***F25C 5/02*** | (2006.01) |
| *F25C 5/04* | (2006.01) |

(52) U.S. Cl.

CPC ..... *F25C 1/16* (2013.01); *F25C 5/02* (2013.01); *F25C 5/08* (2013.01); *F25C 5/04* (2013.01); *F25C 2400/10* (2013.01); *F25C 2600/04* (2013.01); *F25C 2700/02* (2013.01)

(58) Field of Classification Search

CPC ..... F25C 1/00; F25C 1/16; F25C 1/24; F25C 5/04; F25C 5/08; F25C 2400/10; F25C 2600/04; F25C 2700/02

USPC ..... 62/340, 344, 349, 352, 353

See application file for complete search history.

(56) References Cited

U.S. PATENT DOCUMENTS

| | | | | |
|---|---|---|---|---|
| 2,178,020 | A * | 10/1939 | Kucher | F25D 11/00 374/39 |
| 2,691,275 | A * | 10/1954 | Andrews | F25C 1/12 62/123 |
| 3,388,560 | A * | 6/1968 | Moreland, II | F25C 1/04 62/233 |
| 3,443,393 | A | 5/1969 | Goldberg | |
| 3,690,116 | A | 9/1972 | Cheng et al. | |
| 3,859,069 | A | 1/1975 | Seliber | |
| 5,207,073 | A | 5/1993 | Maier-Laxhuber et al. | |

(Continued)

FOREIGN PATENT DOCUMENTS

| | | | | |
|---|---|---|---|---|
| JP | 4131674 A | 5/1992 | | |
| WO | WO 2010003954 A1 * | 1/2010 | | F25C 1/18 |

*Primary Examiner* — Ljiljana Ciric

(57) ABSTRACT

A refrigerator includes an ice making device for producing ice cubes. The ice making device includes a mold body having a plurality of ice forming cavities adapted to hold fluid. In an ice making cycle, air is evacuated from the cavities by a vacuum system, thereby depressurizing the cavities. Then, liquid is delivered to the depressurized cavities by a liquid delivery system, whereby an initial portion of the liquid bubbles up within the respective cavities. Once ice cubes have been formed within the cavities, the cavities are heated by a heat transfer system, thereby partially melting the ice cubes and aiding in the expulsion of ice cubes from the cavities.

11 Claims, 3 Drawing Sheets

(56) References Cited

U.S. PATENT DOCUMENTS

| | | | | |
|---|---|---|---|---|
| 5,732,559 | A * | 3/1998 | Horn | A22C 5/00 62/136 |
| 6,038,869 | A | 3/2000 | Lee et al. | |
| 6,131,397 | A * | 10/2000 | Davis | B64G 1/402 62/47.1 |
| 6,354,102 | B1 | 3/2002 | Hozumi et al. | |
| 6,920,764 | B2 | 7/2005 | Zevlakis | |
| 6,935,124 | B2 | 8/2005 | Takahashi et al. | |
| 7,013,669 | B2 | 3/2006 | Ophir et al. | |
| 2004/0025527 | A1* | 2/2004 | Takahashi | F25C 1/18 62/340 |
| 2005/0035210 | A1* | 2/2005 | Bucceri | G07F 13/00 239/2.2 |
| 2006/0218961 | A1 | 10/2006 | Kim et al. | |
| 2007/0000540 | A1* | 1/2007 | Brunner | F25C 1/147 137/15.07 |
| 2007/0079627 | A1* | 4/2007 | Broadbent | F25C 5/08 62/351 |
| 2011/0209483 | A1* | 9/2011 | Hall | F25C 1/08 62/66 |

* cited by examiner

METHOD FOR FORMING ICE CUBES IN AN ICE MAKING DEVICE

CROSS-REFERENCE TO RELATED APPLICATIONS

This application represents a divisional application of U.S. application Ser. No. 12/723,772, filed Mar. 15, 2010.

BACKGROUND OF THE INVENTION

Field of the Invention

The present invention pertains to the art of refrigerators and, more particularly, to a fast ice making device within a refrigerator.

Description of the Related Art

Whether to ensure an adequate amount of ice for a party or just to keep up with daily demand, there is a need to decrease ice production time. To address this concern in the art of refrigerated appliances, it is known to employ fans or other similar devices to direct air across an ice mold in order to decrease ice production time. Typically, the fan is oriented to direct a flow of air from an evaporator over the ice mold. The flow of air disturbs a thermal barrier that is present about the ice mold in order to increase temperature transfer rates and, as a consequence, decrease an amount of time required to form ice.

While the above described arrangements simply utilize fans, other arrangements expose the ice mold directly to the evaporator and utilize an evaporator fan to blow cool air. In some cases, the evaporator is part of a primary refrigeration system that is employed to maintain temperatures in fresh food and freezer compartments of the refrigerator, while in other cases the evaporator is dedicated to ice production. Dedicated evaporators are typically employed in systems which locate the icemaker in a portion of the refrigerator other than the freezer compartment. While effective, the above described systems typically rely on a cooling demand signal to operate. That is, regardless of a need for ice, the above described systems only function when either the fresh food or freezer compartment requires cooling which necessitates the activation of the refrigeration system. Correspondingly, even during periods when no ice production is required, the above described systems function upon activation of the refrigeration system.

Although the above-described methods reduce ice production time, there still exists the need for ice making systems which can further reduce ice production time within a refrigerator and does not rely on activation of a fan system.

SUMMARY OF THE INVENTION

The present invention is directed to a refrigerator including a fast ice making device. The fast ice making device includes an ice mold body having a plurality of ice forming cavities formed therein. Each of the plurality of ice forming cavities is in communication with a liquid delivery system via one or more liquid lines and liquid inlets. Additionally, a vacuum system includes a vacuum pump which is in communication with each of the plurality of ice forming cavities via one or more pressure lines and pressure inlets.

In use, a controller activates the vacuum system at the beginning of an ice making cycle and air is evacuated from the ice forming cavities, creating reduced or depressurized cavities. A water delivery system then supplies fluid to each of the depressurized ice forming cavities. In accordance with the present invention, due to the vacuum environment, the initial fluid entering the depressurized cavities is caused to boil, i.e., bubble up as trapped air in the fluid rises to the surface, with this boiling establishing a cooler fluid at the beginning of the ice making cycle, thus accelerating the rate at which ice cubes are formed within the fast ice making device. Once ice cubes are formed, a heat transfer system is used to slightly melt the ice cubes to aid in ejection of the ice cubes from the ice mold body.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF PREFERRED EMBODIMENTS

Figure 1:
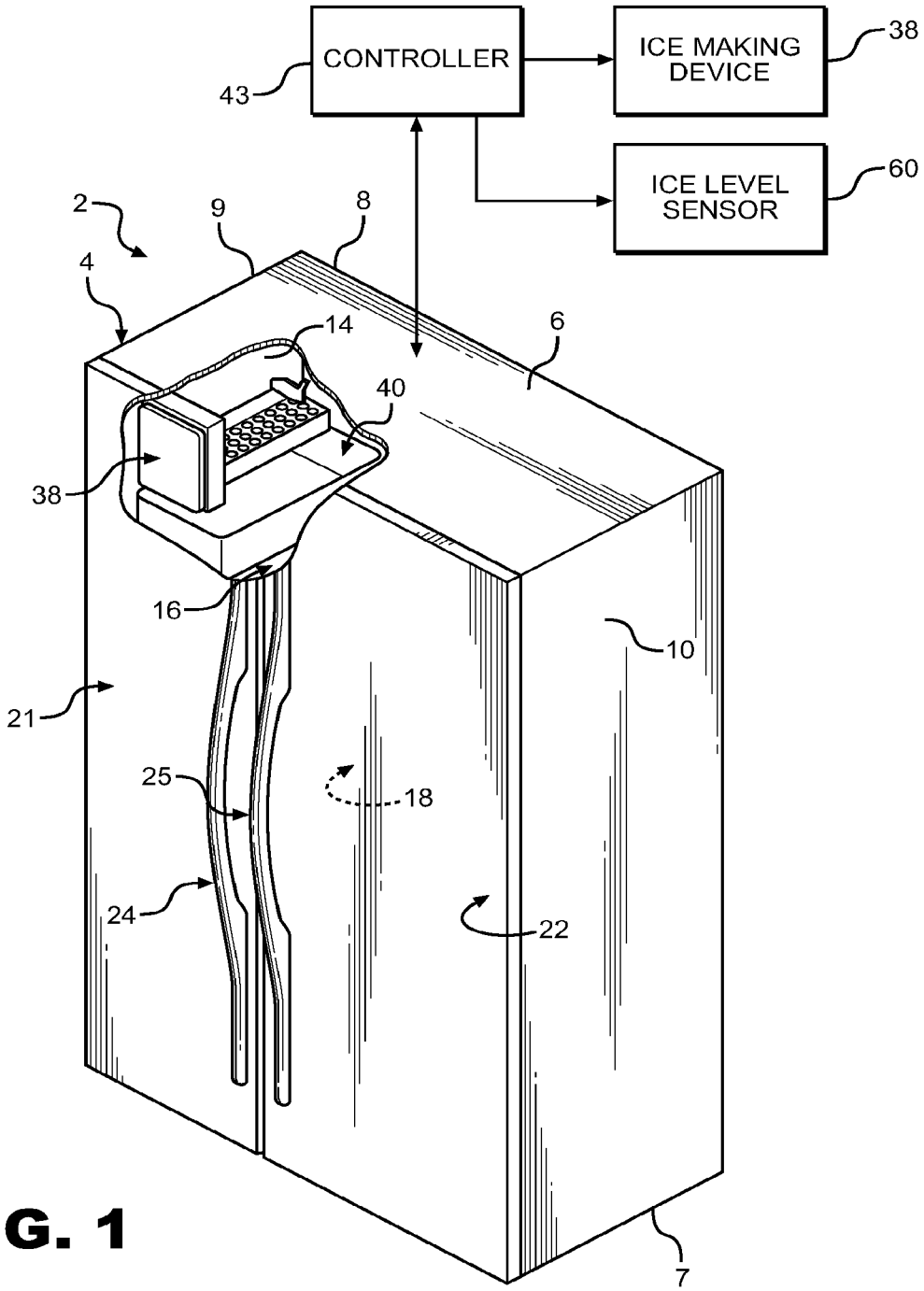
FIG. 1 is an upper left perspective view of a refrigerator incorporating a fast ice making device constructed in accordance with the present invention.

As best shown in FIG. 1, a refrigerator constructed in accordance with the present invention is generally indicated as 2. Refrigerator 2 includes a cabinet 4 having a top wall 6, a bottom wall 7, a rear wall 8, and opposing sidewalls 9 and 10 that collectively define a refrigerator body. Refrigerator 2 is further shown to include a liner 14 that defines a freezer compartment 16. A fresh food compartment 18 is arranged alongside freezer compartment 16 such that refrigerator 2 defines a side-by-side model. Of course, it should be understood that the present invention can be readily incorporated into various refrigerator models, including top mount, bottom mount and French-style door model refrigerators. At this point, it should also be understood that the referenced freezer compartment 16 could be constituted by a dedicated ice producing section provided in the fresh food compartment. In any case, in the exemplary embodiment shown, refrigerator 2 includes a freezer compartment door 21 and a fresh food compartment door 22 pivotally mounted to cabinet 4 for selectively providing access to freezer compartment 16 and fresh food compartment 18 respectively. In a manner also known in the art, each compartment door 21, 22 includes a corresponding handle 24, 25.

In accordance with the invention, refrigerator 2 is provided with a fast ice making device 38 for dispensing ice into an ice cube storage bin 40. As will be discussed more fully below, fast ice making device 38 produces ice cubes in less time than conventional icemakers. Toward that end, various functions of fast ice making device 38 are controlled a controller 43. In accordance with the present invention, controller 43 can be incorporated into fast ice making device 38, or may be a separate part of refrigerator 2.

Figure 2:
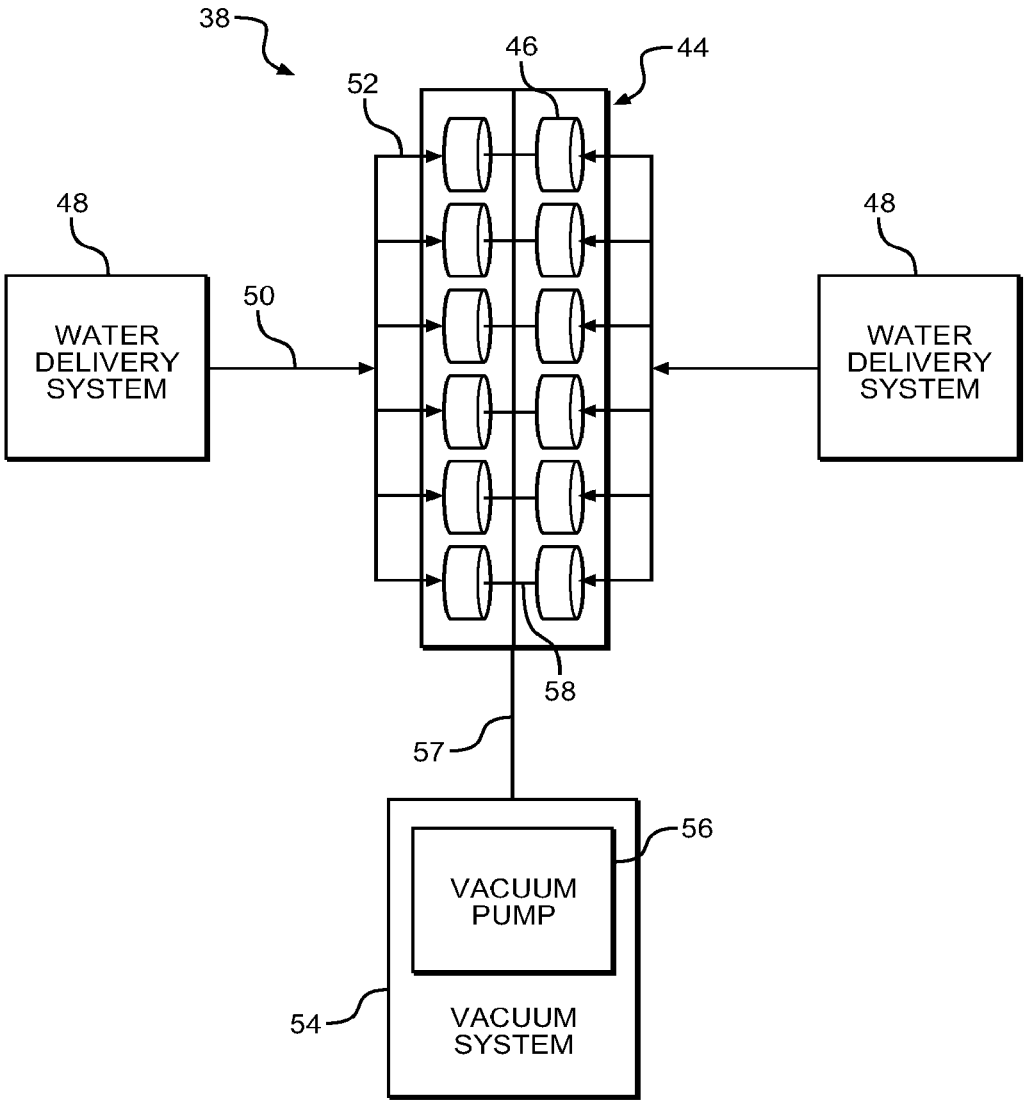
FIG. 2 is a schematic side view of the ice making device of FIG. 1.
Figure 3:
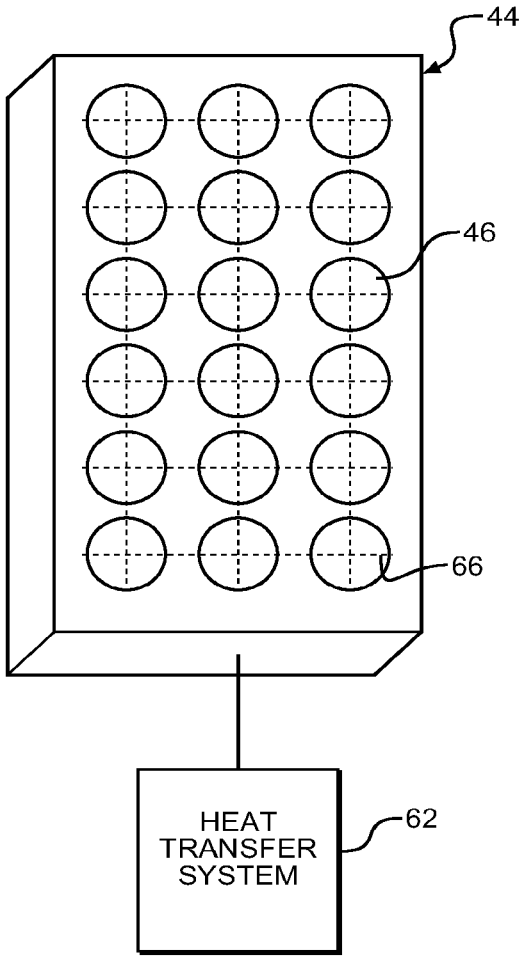
FIG. 3 is a schematic front view of the ice making device of FIG. 1.

As best seen in FIGS. 2 and 3, fast ice making device 38 includes a mold body 44, shown with two sealably mating, symmetrically constructed mold body portions, establishing a plurality of ice forming cavities 46. In the preferred embodiment shown, each ice forming cavity 46 has a generally cylindrical shape for producing correspondingly shaped ice cubes. However, it should be understood that ice forming cavities 46 can take on any shape to produce a desired ice cube appearance. Each of the plurality of ice forming cavities 46 is in communication with a liquid delivery system 48 via one or more liquid lines 50 and liquid inlets 52. Additionally, each of the plurality of ice forming cavities 46 is in communication with a vacuum system 54. More specifically, in accordance with the present invention, a vacuum pump 56 is in communication with each of the plurality of ice forming cavities 46 via one or more pressure lines 57 and pressure ports 58.

In use, when the need for ice cubes is detected, controller 43 activates vacuum pump 56 of vacuum system 54 which evacuates air from ice forming cavities 46, creating depressurized, i.e., reduced pressure or vacuum, cavities. It should be understood that the need for ice cubes can be determined using any conventional technology, such as a bale arm or other known ice level sensor system as generically represented by ice level sensor 60 depicted in FIG. 1. Next, water delivery system 48 is activated and fluid is supplied to each of the depressurized ice forming cavities 46. In accordance with the present invention, the initial supply of fluid entering depressurized cavities 46 is caused to boil, i.e., bubble up so that air bubbles in the fluid rises to the surface. With a reduced gas content due to lack of entrapped air, the fluid has an increased heat transfer potential at the beginning of an ice making cycle, thus accelerating the rate at which ice cubes are formed within fast ice making device 38.

The formation of ice cubes within cavities 46 may be determined in a manner known in the art, such as by positioning one or more sensors (not shown) directly in fast ice making device 38 or after a predetermined period of time has passed. Once it is determined that ice cubes have been formed, the ice cubes are ejected from mold body 44 in a manner known in the art, such as by utilizing an ejector (not shown) or inverting ice mold body 44. With specific reference to FIG. 3, once ice cubes are fully formed within ice mold body 44, a heat transfer system 62 is preferably utilized to warm ice forming cavities 46 in order to slightly melt ice cubes formed therein to aid in dispensing of the ice cubes from mold body 44. In the preferred embodiment shown, heat transfer device 44 utilizes wires 66 formed within ice mold body 44 to deliver targeted heat to each of the ice forming cavities 46. However, it should be understood that various known heat transfer system 62 could be utilized with the fast ice making device 44 of the present invention.

Although described with reference to preferred embodiments of the invention, it should be readily understood that various changes and/or modifications can be made to the invention without departing from the spirit thereof. For instance, the illustrated and described structure of ice mold body 44 is provided to aid in understanding of the present invention. However, it should be understood that ice mold body 44 could include a different configuration and, with the addition of the features of the invention, the fast ice making arrangement could be incorporated in various known ice-maker systems. In general, the invention is only intended to be limited by the scope of the following claims.

What is claimed is:

1. A method for forming ice cubes in an ice making device including a mold body having at least one ice forming cavity, said method comprising:

activating a vacuum system in communication with the at least one ice forming cavity to evacuate air from the at least one ice forming cavity to establish a depressurized at least one ice forming cavity;

activating a liquid delivery system in communication with the depressurized at least one ice forming cavity to deliver a liquid to the depressurized at least one ice forming cavity;

causing at least an initial portion of the liquid delivered to the depressurized at least one ice forming cavity to boil; and freezing the liquid in the depressurized at least one ice forming cavity to form ice.

2. The method of claim 1, further comprising:

activating a heat transfer system in communication with the depressurized at least one ice forming cavity, wherein the ice formed within the depressurized at least one ice forming cavity is partially melted; and ejecting the ice from the depressurized at least one ice forming cavity.

3. A method of forming ice comprising:

delivering liquid to at least one ice forming cavity formed in a mold body of an ice making device, the ice making device being arranged in a refrigerated compartment; and creating a vacuum within the at least one ice forming cavity to cause an initial portion of the liquid to boil and then forming ice cubes in the mold body.

4. The method of claim 3, further comprising: selectively applying heat to the at least one ice forming cavity.

5. The method of claim 3, further comprising: controlling, with a controller in communication with both a delivery system for the liquid and a vacuum system for creating a vacuum with the at least one ice forming cavity, the selective activating and deactivating of the delivery system and the vacuum system.

6. The method of claim 3, wherein creating the vacuum includes activating a vacuum system in communication with the at least one ice forming cavity to evacuate air from the at least one ice forming cavity to establish a depressurized at least one ice forming cavity.

7. The method of claim 6, wherein delivering the liquid includes activating a liquid delivery system in communication with the depressurized at least one ice forming cavity to deliver the liquid to the depressurized at least one ice forming cavity.

8. The method of claim 7, wherein forming the ice cubes includes freezing the liquid in the depressurized at least one ice forming cavity to form ice.

9. The method of claim 8, further comprising: activating a heat transfer system in communication with the depressurized at least one ice forming cavity, wherein the ice formed within the depressurized at least one ice forming cavity is partially melted.

10. The method of claim 9, further comprising: ejecting the ice cubes from the depressurized at least one ice forming cavity.

11. The method of claim 3, further comprising: forming the ice cubes in the mold body.

* * * * *